US008646120B2

(12) United States Patent
Schueler

(10) Patent No.: US 8,646,120 B2
(45) Date of Patent: Feb. 11, 2014

(54) BATHING DEVICE, SYSTEMS AND METHODS

(75) Inventor: Robert A. Schueler, Franklin, WI (US)

(73) Assignee: In Reserve LLC, Franklin, WI (US)

( * ) Notice: Subject to any disclaimer, the term of this patent is extended or adjusted under 35 U.S.C. 154(b) by 455 days.

(21) Appl. No.: 13/040,724

(22) Filed: Mar. 4, 2011

(65) Prior Publication Data

US 2012/0222209 A1 Sep. 6, 2012

(51) Int. Cl.
*A47K 3/02* (2006.01)

(52) U.S. Cl.
USPC ..... 4/584

(58) Field of Classification Search
USPC ..... 4/538–595
See application file for complete search history.

(56) References Cited

U.S. PATENT DOCUMENTS

| | | | | | |
|---|---|---|---|---|---|
| 1,729,258 | A | * | 9/1929 | Hostetter | 4/584 |
| 1,844,988 | A | | 2/1932 | Steinkamp | |
| 1,979,596 | A | | 11/1934 | Woolfolk | |
| 2,015,021 | A | | 9/1935 | Samelow | |
| 2,030,687 | A | | 2/1936 | Davis | |
| 2,418,915 | A | | 4/1947 | Volk | |
| 2,508,969 | A | | 2/1950 | Richardson | |
| 2,930,047 | A | | 3/1960 | Bowser | |
| 3,157,774 | A | * | 11/1964 | Moore et al. | 392/444 |
| 3,371,354 | A | | 3/1968 | Hayslett | |
| 3,374,492 | A | | 3/1968 | Ruderian | |
| 3,788,306 | A | * | 1/1974 | Eberhard | 601/157 |
| 3,971,080 | A | | 7/1976 | Walker | |
| 4,337,540 | A | * | 7/1982 | Lindeman | 4/546 |
| 4,371,995 | A | * | 2/1983 | Donhauser | 4/538 |
| 4,407,029 | A | | 10/1983 | Schmidt | |
| 4,523,341 | A | * | 6/1985 | Queen | 4/555 |
| 4,672,693 | A | | 6/1987 | Schenstrom | |
| RE32,806 | E | * | 12/1988 | Gurolnick | 4/572.1 |
| 4,970,734 | A | | 11/1990 | Friedman et al. | |
| 5,012,535 | A | * | 5/1991 | Klotzbach | 4/541.2 |
| 5,038,420 | A | * | 8/1991 | Chen | 4/538 |
| 5,636,391 | A | * | 6/1997 | Greene, III | 4/420.3 |
| 6,378,145 | B1 | | 4/2002 | Wyss | |
| 6,507,959 | B1 | * | 1/2003 | Sundberg et al. | 4/572.1 |
| 6,604,709 | B1 | | 8/2003 | Wentland et al. | |
| 6,625,825 | B1 | | 9/2003 | Groner et al. | |
| 6,631,525 | B2 | | 10/2003 | Piatt et al. | |
| 6,725,470 | B2 | | 4/2004 | Webb | |
| 8,230,534 | B2 | * | 7/2012 | Torres et al. | 4/555 |
| 2008/0083063 | A1 | | 4/2008 | Libit et al. | |
| 2009/0133189 | A1 | * | 5/2009 | Ader et al. | 4/546 |
| 2010/0275364 | A1 | * | 11/2010 | Torres et al. | 4/555 |

* cited by examiner

*Primary Examiner* — Lori Baker
(74) *Attorney, Agent, or Firm* — Ryan Kromholz & Manion, S.C.

(57) ABSTRACT

Systems and methods provide improved bathing or soaking mechanisms. A vessel may be provided with a plurality of horizontal support surfaces disposed in a cavity and a plurality of separate drain paths. A lid is adapted to span the cavity and be received in the top of the vessel. The lid may be a two-piece hinged lid, which may be actuated from a closed position to an open position and back again. The lid is provided with one or more drain holes which may cooperate with one of the plurality of drain paths when the lid is in the closed position. The vessel and lid combination may be installed through a floor, beneath a conventional shower stall, to enable showering with such stall without substantial contamination to the vessel.

10 Claims, 10 Drawing Sheets

BATHING DEVICE, SYSTEMS AND METHODS

BACKGROUND OF THE INVENTION

Embodiments according to the present invention relate generally to fluid vessels and more particularly to bathing devices, systems and methods.

The act of bathing generally seems a straightforward, routine act. However, for some members of the population, bathing in a conventional bathtub or shower stall simply is not practicable. For instance, some people prefer to sit while bathing but may be unable to step over the elevated side of a standard bathtub. In addition, people with certain medical conditions, such as artificial hips and/or arthritis, benefit greatly from soaking baths.

Prior attempts have been made at providing modified bathtubs for such people. For example, a walk-in type bathtub has been previously available. Such bathtub includes a generally waist-high wall surrounding a fluid containing vessel. Formed through the wall is a doorway enabling entry and exit to and from the vessel. Sealing the doorway is usually a hinged door that must remain closed during the times at which the vessel is being filled and drained of fluid. Within the vessel, there may be included or inserted a form of seating surface so that a user may be seated in an upright seated position above the floor of the vessel.

While the prior walk-in type bathtub designs of the past generally address some disadvantages of standard continuous wall tubs and shower stalls, there remains room for improvement in the art. For example, the hinged door provided on prior designs may cause inconvenience to some users. That is, the door must remain closed, in a sealing position, while the tub is being filled with and drained of water or other fluid.

Such closed door creates a barrier to any entry or exit to or from the bath at the user's leisure or convenience during the filling or draining process. Accordingly, a user must remain inside the tub during filling and draining. Not only would such position likely be uncomfortable for users that may be nude, and thus chilled, during the filling and draining process, it is a waste of the user's time. Assuming a "fast" fill rate of about 15 gallons per minute and a tub size of between 50 and 100 gallons, a user could waste up to 5-15 minutes per bath, or more, of combined restricted user time during the fill and drain procedures. If a bath is taken every day, such time aggregates to more than two straight days of wasted time per year.

Another example of room for improvement is that, to be properly utilized, some prior devices require floor space outside of a bathroom. Some prior devices are not amenable to replacement of existing bathroom fixtures, whether due to device size, or due to the bathing requirements of other members of the user's household. Additionally, once a tub is filled with water or other fluid, the space generally occupied by the tub generally serves a single purpose. It may be desirable to virtually hide the tub so that other uses may be made of the space, even if the tub is filled.

Accordingly, there remains room in the art for improved bathing devices, systems and methods that may provide improved time usage and/or space savings.

SUMMARY OF THE INVENTION

Embodiments of the present invention provide improved bathing devices, systems and methods that may provide improved time usage and/or space savings.

According to one aspect of an embodiment according to the present invention, a bathing device is provided. The bathing device includes a vessel having a cavity that is defined by at least one wall, including a substantially horizontal bottom portion and at least one sidewall. A first drain hole may be formed in the bottom portion of the wall. A second overflow drain hole may be formed through the wall in a surface that is substantially parallel to the bottom portion of the wall. The overflow surface may extend into the cavity from or be supported atop the at least one sidewall. The wall may at least partially define an open vessel top and the overflow surface is preferably disposed between the vessel top and the bottom portion. The overflow drain surface may be disposed closer to the vessel top than to the bottom portion.

According to another aspect of an embodiment according to the present invention, a selectively closeable, preferably remotely operable, drain valve may be provided having an input in fluid communication with the first drain aperture and an output in fluid communication with a drain pipe. The drain valve may be cable actuated. If provided, the second drain aperture formed through the vessel or other structure is also preferably in fluid communication with the drain pipe.

According to another aspect of an embodiment according to the present invention, a bathing device including a vessel and a lid may be provided. A fluid containing vessel may include an open top. The lid may be configured to nest in the vessel top and include at least one drain hole formed therethrough. The vessel may include a first drain hole formed through the vessel, such as through a vessel wall or other surface, where the first drain hole is adapted to drain fluid from a majority of the volume defined by the vessel. A second drain hole is preferably provided to receive fluid from the drain hole formed in the lid while the lid is nested in the vessel. The second drain hole may be provided formed through the vessel, such as through a vessel wall or other surface. Alternatively, the second drain hole may be provided in a structure coupled to or in operative connection with the lid and/or vessel.

According to an embodiment of a lid according to the present invention, the lid preferably has a top surface and a bottom surface. When the lid is nested in the vessel, the bottom surface is oriented towards the first drain aperture and the second drain aperture, which are formed in the vessel or other structure. The lid top surface may further include at least one drain channel configured to guide fluid from the lid top surface towards the at least one drain hole.

According to another aspect of an embodiment of a lid according to the present invention, the lid may include a plurality of lid panels having substantially planar top surfaces. The plurality of lid panels may include a first lid panel and a second lid panel, which may be hingedly coupled. The first lid panel may be pivotably coupled to the vessel. The second lid panel may be translatable across at least a portion of the vessel.

According to an aspect of an embodiment of a method according to the present invention, such method may be a method of installing a bathing device. The method includes the step of providing a vessel having a cavity and a first drain aperture. The first drain aperture is placed in fluid communication with a drain pipe thereby establishing a first fluid drain path from the cavity to the drain pipe. The vessel may be covered with a lid having at least one drain hole formed therethrough. The lid may be nested in a top portion of the vessel. A second fluid drain path is established between the at least one drain hole in the lid and the drain pipe. The second fluid drain path is preferably separate from the first fluid drain path, but in any event preferably excludes the first drain aperture.

According to another aspect of a method according to the present invention, a vessel may be installed below floor level in a building structure. The method may further include the step of interfacing a shower stall, prefabricated or otherwise, with the vessel, where the lid that covers the cavity is configured to be utilized as a floor of the shower stall. Walls of the shower stall preferably overlap a portion of the vessel. A shower door may be installed to close off the single- or more-walled shower stall, and such may be suspended over a threshold provided on the vessel, where a top surface of such threshold is preferably positioned above an overflow surface. Additionally, the threshold may include the top surface positioned above a lid covering the vessel.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
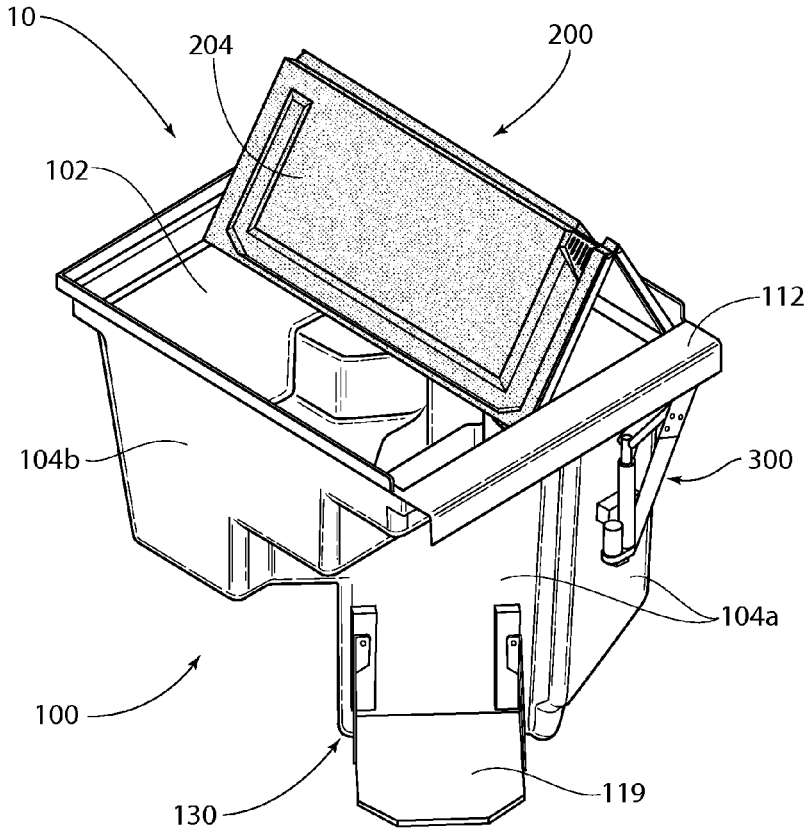
FIG. 1 is a perspective view of an embodiment of a bathing system according to the present invention.

Turning now to the figures, FIG. 1 depicts a first embodiment 10 of a bathing system according to the present invention. Generally, the system 10 includes a vessel 100 and a lid 200. With reference also to FIGS. 2-9, the vessel 100 will be further described.

A vessel 100 according to the present invention generally includes a rectilinear top surface 101 extending along a length 101*a* and a width 101*b*. The vessel 100 comprises a cavity 102 defined by a plurality of wall portions 104 and a floor portion 106. The wall portions 104 preferably include four wall portions: a front wall portion 104*a*, a left wall portion 104*b*, a rear wall portion 104*c*, and a right wall portion 104*d*. Each wall portion 104 is preferably coupled to one or more additional wall portion 104, preferably being formed integrally therewith. The cavity 102 has a volume of preferably between about 50 to about 100 gallons, and more preferably between about 60 to about 80 gallons.

Provided at the top of the front wall portion 104*a* is a front lid support surface or ledge 106*a*, and provided at the top of the rear wall portion 104*c* is a rear lid support surface or ledge 106*b*. The lid support surfaces 106*a,b* are preferably substantially planar surfaces that are preferably coplanar and parallel to each other. Disposed at the top of at least one of the left wall portion 104*b* and the right wall portion 104*d* is a lid storage surface 106*c*. The lid storage surface 106*c* may be a substantially planar surface extending longitudinally between and coupling the front lid support surface 106*a* and the rear lid support surface 106*b*, and is preferably lying substantially coplanar therewith. The lid storage surface 106*c* preferably has a width, measured perpendicular to its longitudinal length, that is substantially equal to or greater than the sum of the thicknesses of all of the lid panels, in this embodiment 202,204. Such width provides for convenient storage of the lid panels 202,204 when the lid 200 is open and the vessel 100 is in use.

Provided about the perimeter of one or more sides of the top of the vessel 100 is preferably a tiling flange 108. When the vessel 100 is installed in a building, it is expected that either tile or some other fluid impervious material would overlay the tiling flange 108 so as to provide a fluid drainage path. Extending preferably the entire distance of the rear lid support surface 106*b* is a lid clearance spacer portion 110. The spacer portion 110 accommodates for the thickness of the expected tile or other material overlaying the rear tiling flange 108, such that when the lid 200 is operated, as hereafter described, the lid 200 will have sufficient clearance to pass by such tile. Coupled to or formed integrally with the spacer portion 110 is a bearing block 111, which may interface with a preferred lid 200 as described hereafter.

Extending upward and outward from one or more of the front lid support surface 106*a*, the rear lid support surface 106*b*, the lid storage surface 106*c* or otherwise from the top of the vessel 100 is preferably a threshold 112. The threshold 112 preferably has a top surface 112*a* that is stationarily positioned at a height from the lid support surface 106*a,b* that is at least equal to the thickness of the lid 200, as hereafter described, but is preferably greater than the thickness of the lid 200. Thus, when the lid 200 spans the cavity 102 and is supported by the lid support surfaces 106*a,b*, such relationship between the threshold top surface 112*a* and the lid support surfaces 106*a,b* may provide a substantially planar transition from threshold 112 to lid 200.

Provided through the vessel 100 are a plurality of apertures. Generally, these holes may be categorized as drain holes 114 and/or accessory holes 116. Preferably, a plurality of drain holes 114 is provided. A first drain hole 114*a* is preferably provided at the bottommost point of the vessel 100 to ensure proper fluid drainage from a majority of the cavity 102. Additionally, a second drain hole 114*b* is preferably provided as an overflow drain. Unlike most conventional overflow drains that are provided on a vertical vessel surface, the overflow drain 114*b* of this embodiment is preferably provided through a substantially horizontal overflow drain surface 115, which may be an extension of the front lid support surface 106*a*. Thus, the first drain hole 114*a* and the second drain hole 114*b* are horizontally and vertically spaced from each other, but provide drainage in the same direction, namely preferably downward.

Figure 2:
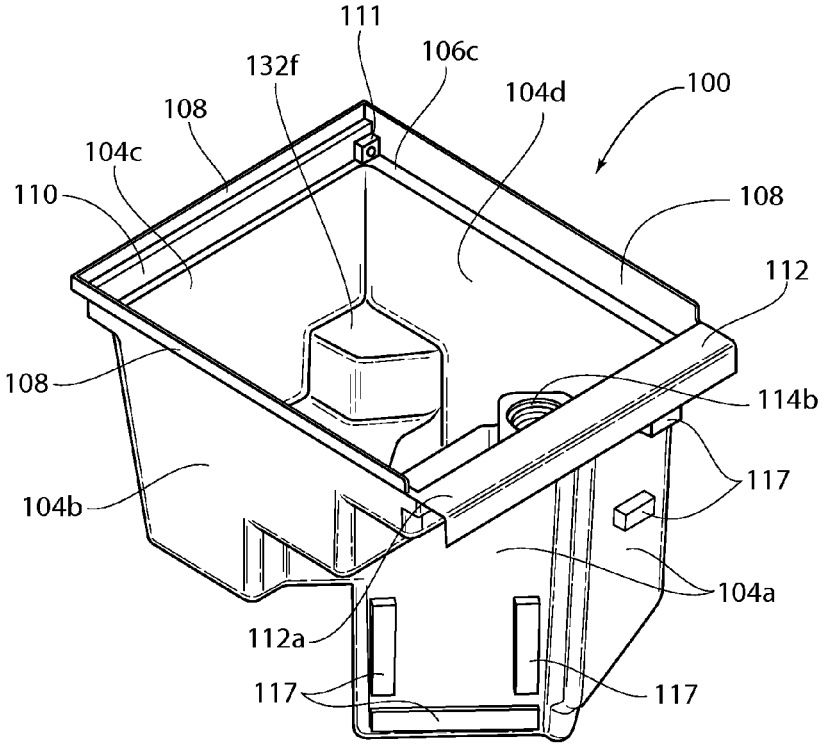
FIG. 2 is a perspective view of an embodiment of a fluid vessel according to the present invention.

As shown in FIG. 2, the wall portions 104 of the vessel 100 may include accessory mounting blocks 117 extending outward therefrom. Such mounting blocks 117 may be formed integrally with the wall portions 104 or may be coupled thereto, such as with an epoxy resin. The mounting blocks 117 may directly support an accessory, such as a lid actuator 300, as further described below, or the blocks 117 may indirectly support an accessory, such as pumps 402,404 which may be mounted to a shelf 119 directly coupled to one or more mounting blocks.

Figure 3:
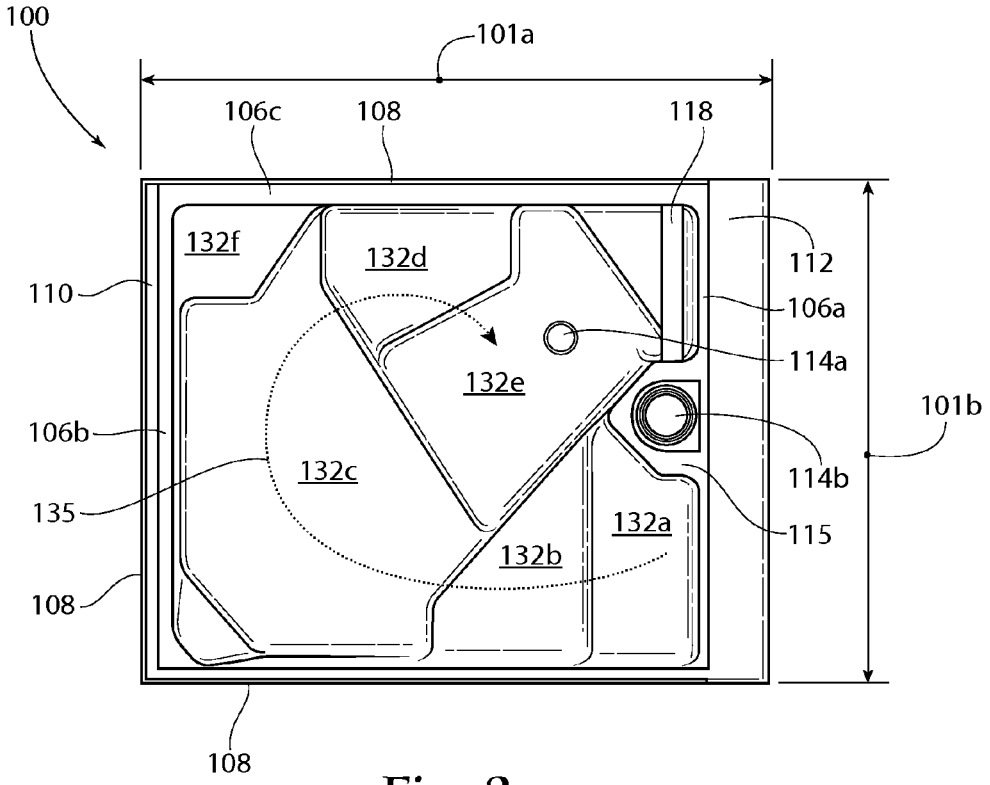
FIG. 3 is a top plan view of the embodiment of FIG. 2.
Figure 4:
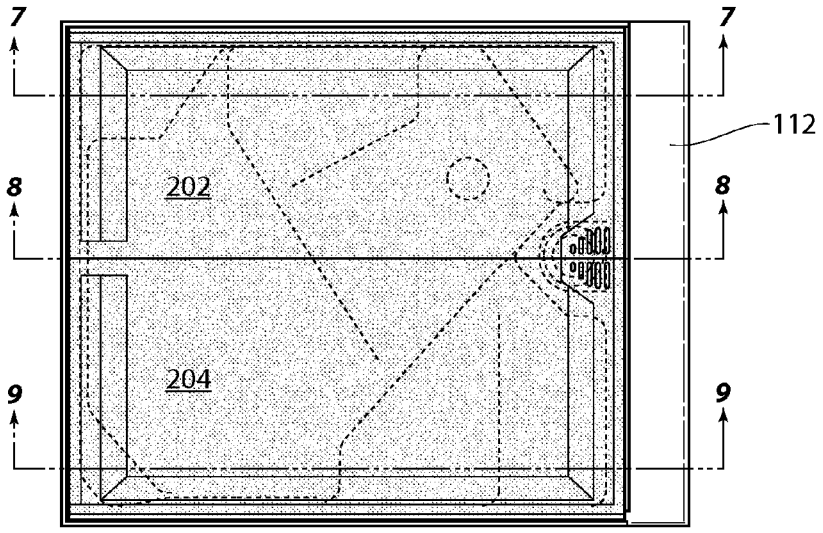
FIG. 4 is a top plan view of the embodiment of FIG. 1.
Figure 7:
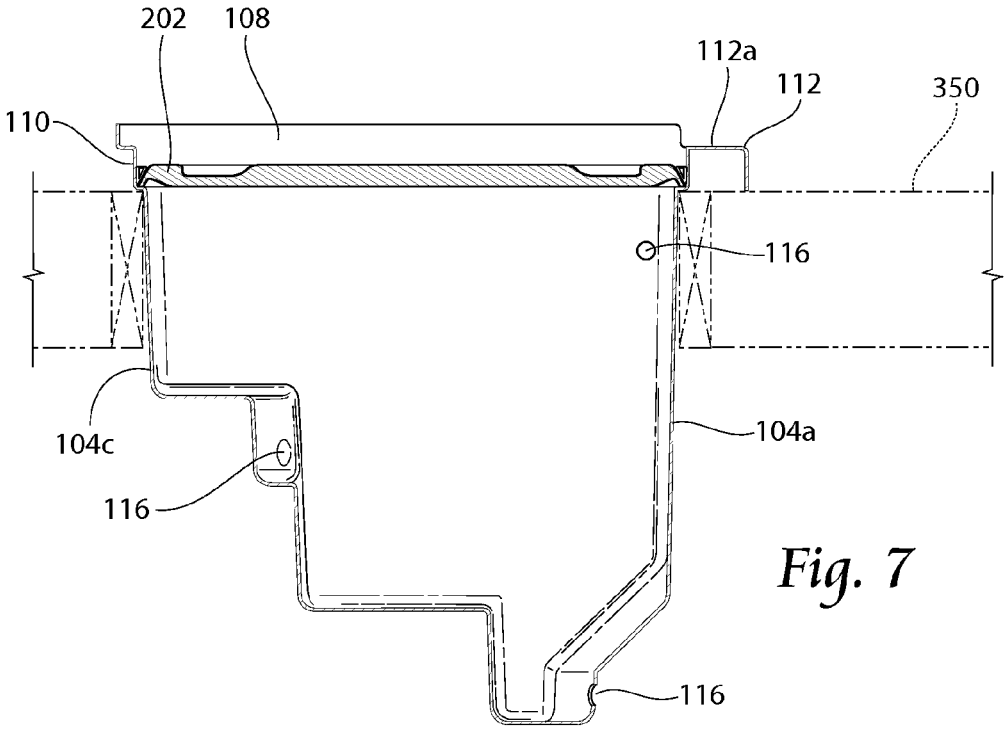
FIG. 7 is a cross-section view taken along line 7-7 of FIG. 4.
Figure 8:
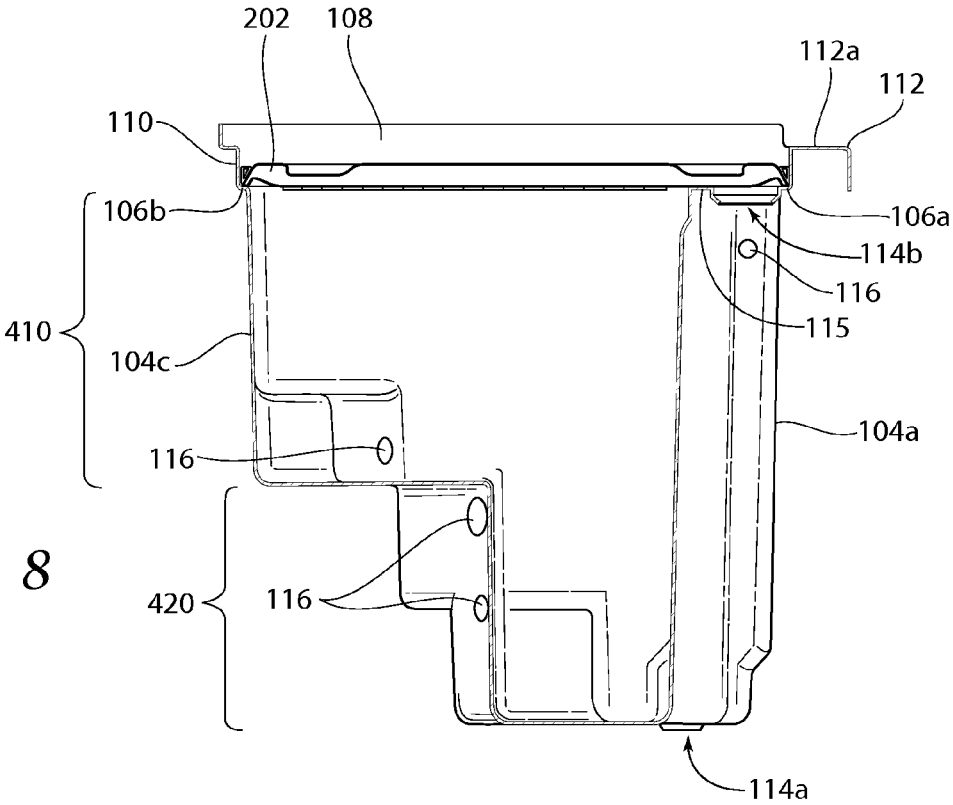
FIG. 8 is a cross-section view taken along line 8-8 of FIG. 4.
Figure 9:
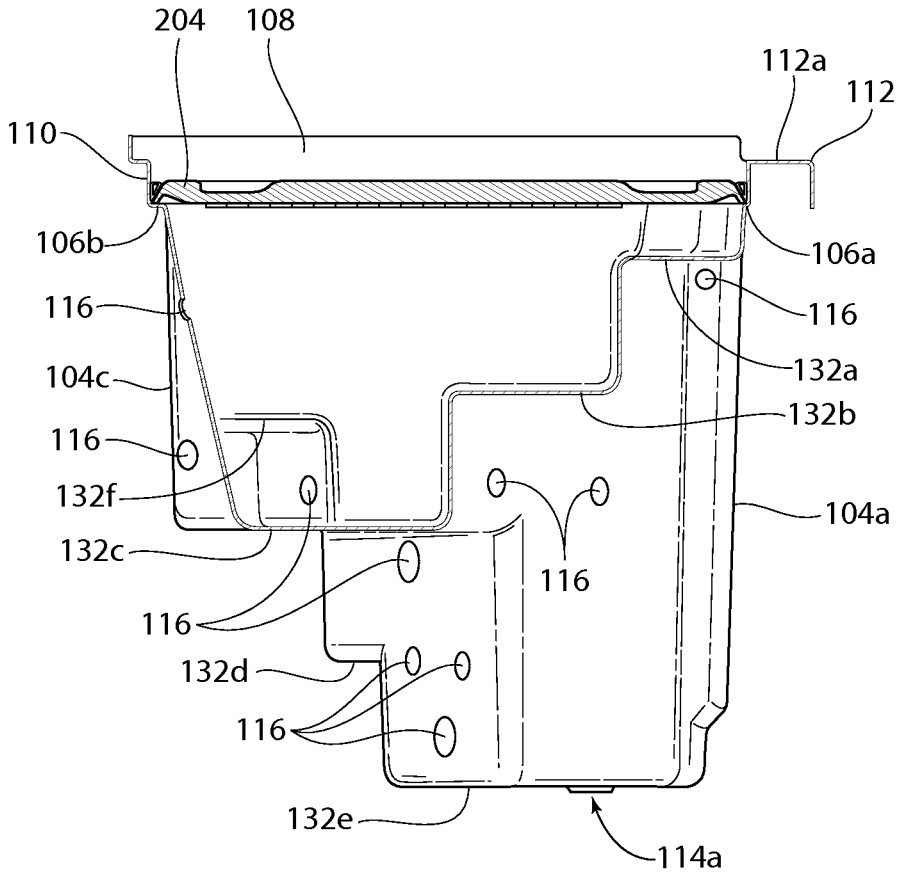
FIG. 9 is a cross-section view taken along line 9-9 of FIG. 4.

As shown in FIGS. 7-9, the wall portions 104 may include one or more accessory apertures 116 formed therethrough. Such accessory apertures may be adapted to receive, for example, a user support grab bar 118, as shown in FIG. 3, which may be an acrylic material that is at least partially transparent or translucent and may be backlit. Other accessories that may be mounted through accessory apertures 116 include chromatherapy lights (not shown).

Figure 6:
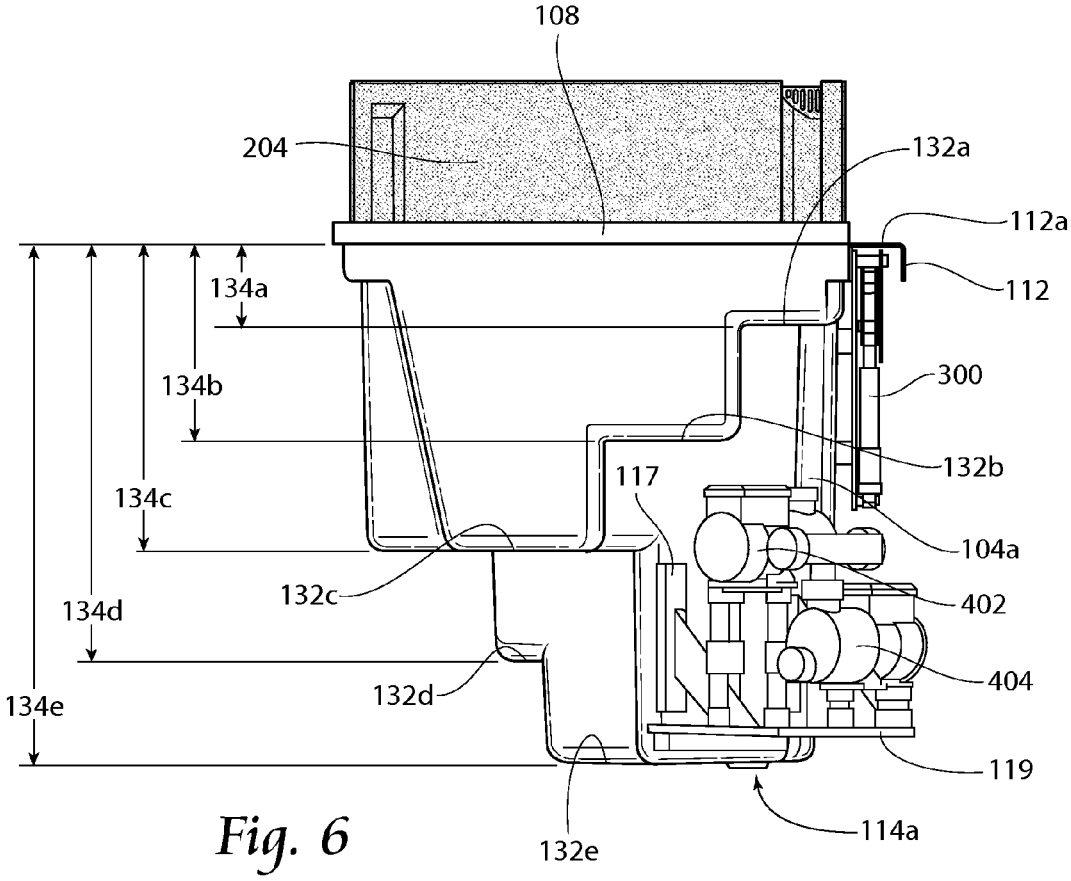
FIG. 6 is a left side elevation view of the embodiment of FIG. 1.

Still other accessories that may be mounted in such apertures 116 include fluid nozzles and/or intakes, such as air or water nozzles or intakes, for providing soothing massage to various portions of a user's body. As can be seen in FIG. 6, one or more pumps 402,404 may be mounted to or supported by or near the vessel 100. Outputs from the pumps 402,404 may extend to water nozzles (not shown) disposed in one or more accessory apertures 116. Inputs to the pumps 402,404 may draw fluid from the vessel through fluid ports (not shown) disposed in one or more accessory apertures 116. In a preferred arrangement, a plurality of separately controllable pumps 402,404 may be used to separate the massage functionality into zones, such as an upper massage zone 410 and a lower massage zone 420. Thus, all outputs from the upper zone pump 402 may be coupled to water nozzles disposed above a certain level, such as above the seat 132*c*, and all outputs from the lower zone pump 404 may be coupled to water nozzles disposed below a certain level, such as below the seat 132*c*. The fluid intake for each respective pump 402,404 is preferably located at a minimum height from the base platform 132*e* of the vessel 100, where such minimum height is the height of the lowermost water nozzle output located in the same zone. Though not necessary, such minimum height location of the fluid intakes, which are preferably mounted in the accessory apertures 116, is advantageous to prevent inadvertent discharge through water nozzles that may not be submerged when the vessel 100 is filled to a certain fluid level. To be certain that no accidental discharge is experienced, the water intakes may be located at or above a height of the highest located water nozzle for a given zone. Various pumps suitable for operation of the massage feature of the tub are known in the art. The plumbing coupled to the pumps 402,404 may include one or more in-line heaters (not shown) to heat circulating fluid that may remain in the vessel 100 in an effort to conserve fluid such as water. The plumbing may alternatively or additionally include an ozonator (not shown) to help control bacteria levels in the fluid. The electrical or pneumatic switch controls for the pump(s) 402,404 may be located outside of the vessel 100, or may alternatively be disposed in a side wall thereof, above a predetermined expected fluid fill line, for easy operation during use of the tub.

Figure 5:
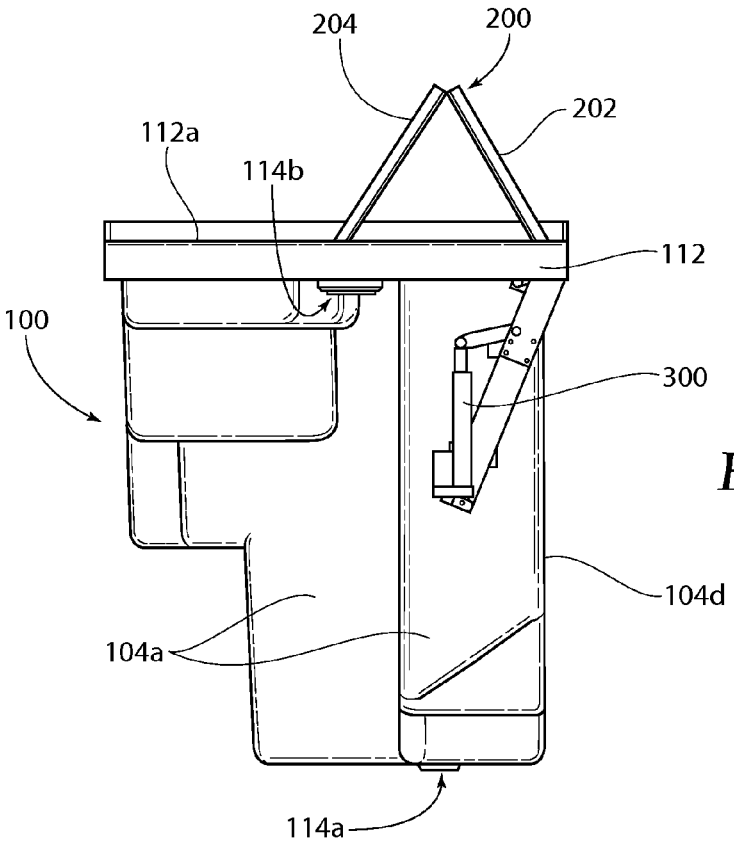
FIG. 5 is a front elevation view of the embodiment of FIG. 1.

The floor portion 130 is preferably a stepped floor portion including a plurality of support surfaces 132 provided at varying depths into the cavity 102. The support surfaces 132 may include a first step 132*a*, a second step 132*b*, a third step (or seat) 132*c*, a fourth step 132*d*, and a base platform 132*e*. Additional accessory support surfaces may further be provided, such as an accessory shelf 132*f*. As mentioned, the support surfaces 132 are preferably provided at varying depths within the cavity 102. As shown in FIGS. 5-6, the first step 132*a* is preferably provided at a first depth 134*a* relative to the threshold top surface 112*a*, or relative to the top of the lid 200 when closed. The second step 132*b* is preferably provided at a second depth 134*b* relative to the threshold top surface 112*a*, or relative to the top of the lid 200 when closed. The seat 132*c* is preferably provided at a third depth 134*c* relative to the threshold top surface 112*a*, or relative to the top of the lid 200 when closed. The fourth step 132*d* is preferably provided at a fourth depth 134*d* relative to the threshold top surface 112*a*, or relative to the top of the lid 200 when closed. Finally, the base platform 132*e* is preferably provided at a fifth depth 134*e* relative to the threshold top surface 112*a*, or relative to the top of the lid 200 when closed. Preferably, at least one of second through fifth depths 134*b*-*e* is substantially equal to a multiple of the first depth 134*a*. Most preferably, each of the second through fifth depths 134*b*-3 is a multiple of the first depth 134*a*. A preferred first depth 134*a* is about four inches to about ten inches, more preferably about seven inches to about nine inches, and most preferably about eight and one-half inches. At least a plurality of the support surfaces 132 are preferably arranged with increasing depths 134 forming a generally spiral staircase path 135. Thus, preferably each support surface extends into a substantially vertical riser portion that may be substantially planar, but disposed in different, preferably unparallel, planes.

The vessel 100 is preferably formed as a unitary member of fiber reinforced laminate, such as a polyester based resin and fiberglass sheet laminate. Such laminate may be built up as is known in the art, using, for example, a hand lay-up or spray lay-up process, which may begin by coating a molding tool with a gelcoat layer and then alternating application layers of resin and fiberglass cloth or sheet materials, until a desired thickness, such as about 0.25 inches, is achieved. Certain areas of the vessel 100 may be reinforced with a bulking filler, such as a polyester nonwoven mat material. For instance one or more of the support surfaces 106*a,b,c,d,e,f* may be reinforced with such material placed between layers of fiberglass mat. An example of such polyester nonwoven mat is Lantor Coremat® available from Lantor Composites of Veenendaal, Netherlands. A preferred filler thickness is about 0.125 to about 0.25 inches, with a more preferred thickness of about 0.125 to about 0.19 inches.

Turning now to FIGS. 1 and 10A-10E, an embodiment 200 of a preferred lid according to the present invention may be further described. A preferred lid 200 may include two sections 202,204 having at least substantially planar top surfaces 202*a*,204*a* that may be at least substantially reflectionally symmetrical to each other. A first lid section, the right lid section 202, is preferably substantially rectilinear and extends along a first lid length 203, which is preferably shorter than the vessel length 101*a* previously described, between a rear end 206 and a front end 208. The section 202 further preferably extends along a first lid section width 205, which is preferably shorter than one-half of the vessel width 101*b* previously described, between a right side 210 and a left side 212. Disposed along one or more of the rear end 206, the right side 210, the front end 208, and/or the left side 212 is a lid seal 214. A preferred lid seal 214 is disposed along at least the front end 208 and the rear end 206. A preferred seal material is an ethylene propylene diene monomer (EPDM) material preferably formed as a tubular member having a closed substantially D-shape cross-section. A central lumen 215 formed by the seal 214 may have a variety of cross-sectional shapes, such as D-shaped or circular, but a preferred cross-section is a substantially rhomboid, or a rhombus as shown. Though the other cross-sections may be used, such a cross-section, as compared to others such as the D-shaped cross-section, is preferred as it provides superior seal deformation.

A second lid section, the left lid section 204, is preferably substantially rectilinear and extends along a lid length 207, which is preferably shorter than the vessel length 101*a* previously described, between a rear end 216 and a front end 218. The second lid length 207 is preferably substantially the same as the first lid length 203, if not identical. The section 204 further preferably extends along a second lid section width 209, which is preferably shorter than one-half of the vessel width 101*b* previously described, between a left side 220 and a right side 222. The sum of the first lid width 205 and the second lid width 209, and any width added by any seals 214 provided thereon, is equal to an overall lid width 211. The overall lid width 211 is preferably slightly larger than the width of the vessel 110 measured between the tiling flanges 108 so as to ensure a proper seal between the lid panels 202,204 and the tiling flanges 108. Disposed along one or more of the rear end 216, the left side 220, the front end 218, and/or the right side 222 is a lid seal 214. A preferred lid seal 214 is disposed along at least the front end 218 and the rear end 216, and most preferably also on the left side 220. A preferred seal material is an ethylene propylene diene monomer (EPDM) material preferably formed as a tubular member having a closed substantially D-shape cross-section. A central lumen 215 formed by the seal 214 may have a variety of cross-sectional shapes, such as D-shaped or circular, but a preferred cross-section is a substantially rhomboid, or a rhombus as shown. As stated above, though the other cross-sections may be used, such a cross-section, as compared to others such as the D-shaped cross-section, is preferred as it provides superior seal deformation.

Figure 10A:
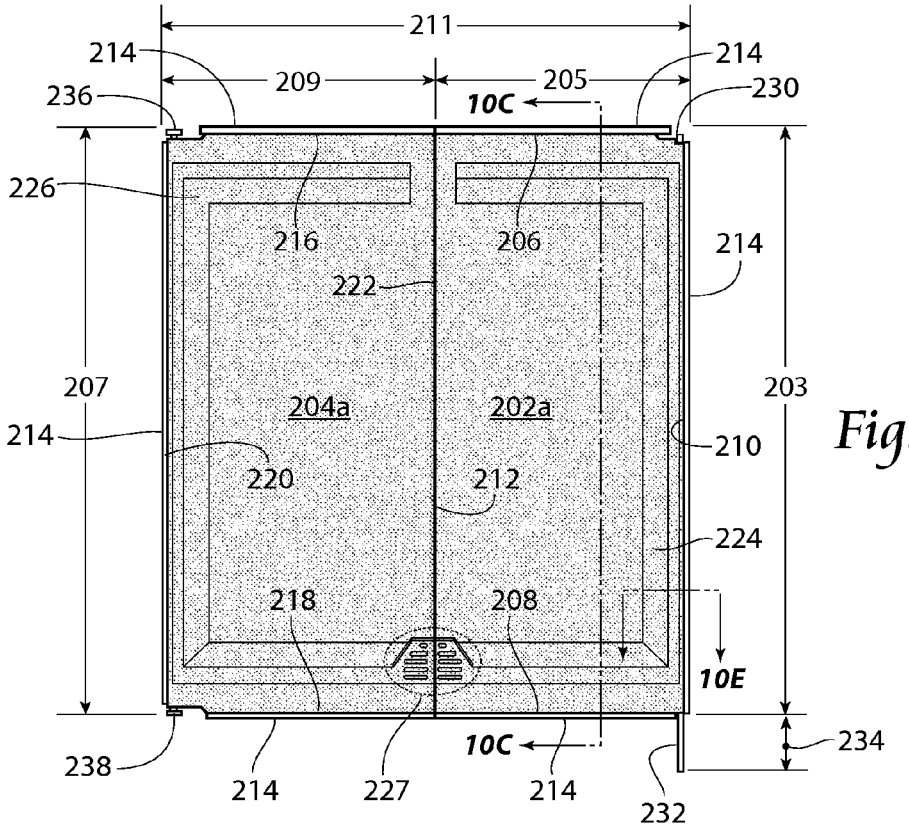
FIG. 10A is a top plan view of an embodiment of a lid according to the present invention.
Figure 10B:
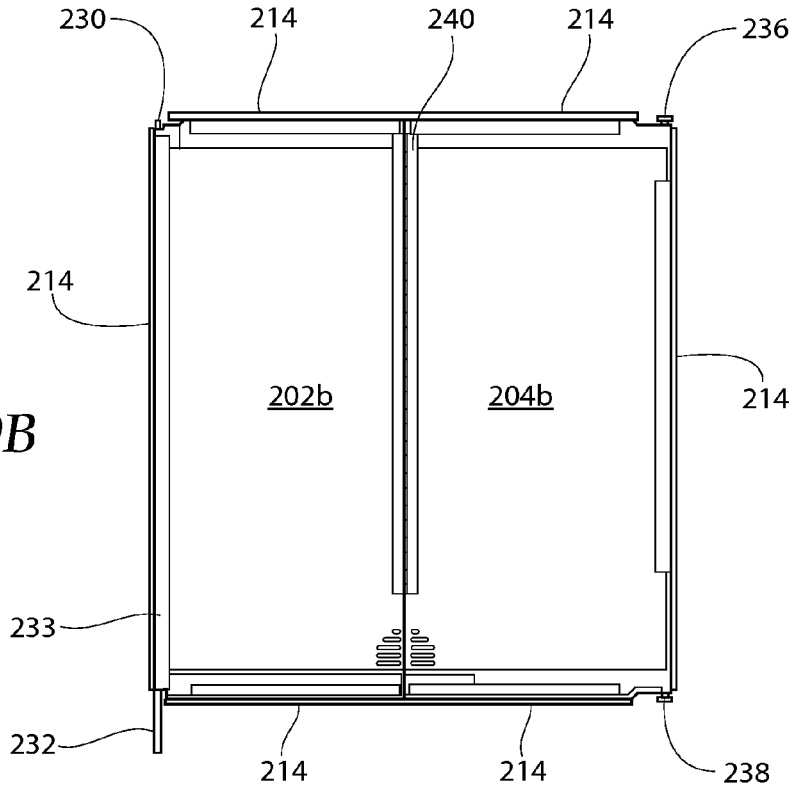
FIG. 10B is a bottom plan view of the embodiment of FIG. 10A.
Figure 10C:
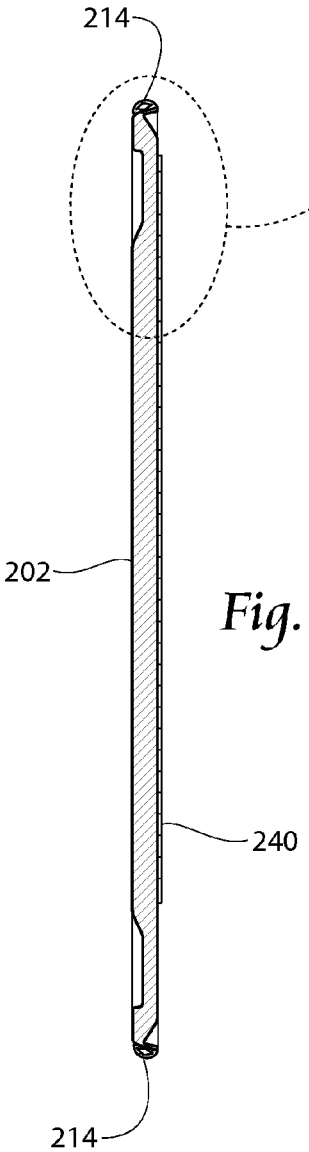
FIG. 10C is a cross-section view taken along line 10C-10C of FIG. 10A.
Figure 10D:
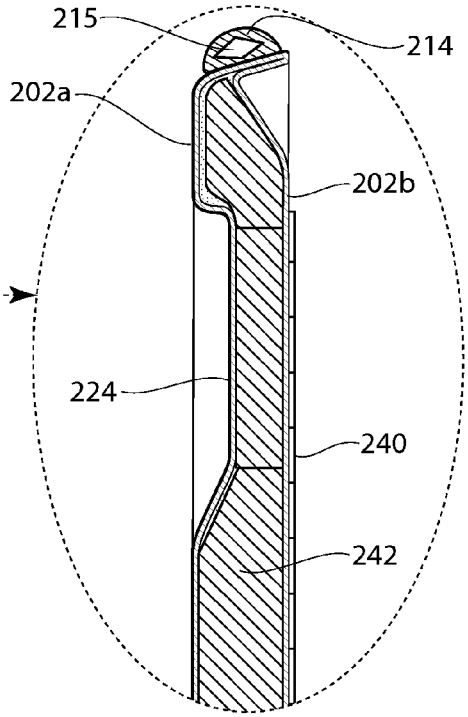
FIG. 10D is an enlarged cross-section view of a portion of FIG. 10C.

As can be seen in FIGS. 10A and 10D, and others, preferably formed into the top surface 202*a*,204*a* of the lid panels 202,204 are drain channels 224,226. The drain channels direct fluid towards one or more drain holes 227 formed in one or both of the panels 202,204. The top surfaces 202*a*,204*a* are preferably slightly crowned so as to guide fluid dropped thereon to the drain channels 224,226 and into the drain holes 227. If there is more than one lid panel provided, as in the depicted embodiment, the drain channel(s) 224,226 preferably extend around less than 360 degrees of the lid 200. Most preferably, if drain holes 227 are not provide at the seam where two lid panels abut, the channels preferably do not extend across such abutment. Thus, as can be seen in FIG. 10A, the drain channel 224 formed in the right lid panel 202 stops short of the left side 212 of that panel. Likewise, the drain channel 226 formed in the left lid panel 204 stops short of the right side 222 of that panel. Accordingly, drainage of fluid from above the lid 200 and into the abutment of the two panels 202,204 may be minimized.

Coupled to or formed integrally with one or more of the lid panels 202,204 are preferably various lid support members. In the embodiment 200 shown, a pivot fulcrum is formed by a pivot pin 230 extending from the rear end 206 of the first lid panel 202 and a pivot rod 232 extending from the front end 208 of the first lid panel 202. The pivot pin 230 and rod 232 are preferably substantially cylindrical in shape and are arranged in a substantially coaxial arrangement. The pivot pin 230 is preferably a stainless steel cylinder that is adapted to rest pivotably journaled in the bearing block 111 provided in the vessel 100. The pivot rod 232 is preferably a stainless steel rod that extends from the front end 208 of the right lid panel 202 by a preferred actuation distance 234, such as between about 0.5 and about 3.5 inches and more preferably between about 2 and about 3 inches. A pivot rod support plate 233 is preferably coupled to or formed integrally with the lid panel 202, such as being adhered to a lid panel bottom surface 202*b*. The support plate 233 is preferably formed from stainless steel sheet material and, in cooperation with the lid panel bottom surface 202*b*, forms a tubular structure into which the pivot rod 232 may be inserted. The pivot rod 232 may then be welded or otherwise adhered to the support plate 233. While the pivot rod 232 could extend through the entire lid length 203 and actually perform the pivot pin 230 function itself, the rod 232 preferably extends only through less than half of the lid length 203. The box section of the tubular structure formed by the support plate 233 and the lid panel 202 adds sufficient strength to resist failure during normal use. The pivot rod 232 is then mechanically coupled, through one or more linkages, to a preferred actuator, such as a linear electric solenoid actuator 300, which may be mounted to the vessel 100.

Other lid support members may be provided. For instance on the left side of the lid 200, one or more roller bearings 236,238 may be provided. Preferably, one roller bearing 236 is provided at the rear end 216 of the left panel 204 and one roller bearing 238 is provided at the front end 218 of the left panel 204. The respective locations at which the roller bearings 236,238 are situated on the panel 204 are preferably indented so as to allow the outer substantially planar surface of the roller bearings 236,238 to be situated at a distance substantially equal to the second lid length 207. Thus, the support members described may work in concert to assist in the raising and lowering of the lid 200 in the embodiment shown. When the pivot rod 232 is rotated by the actuator 300, the roller bearings 236,238 follow and roll along the rear lid support surface 106*b* and the front lid support surface 106*a*, respectively.

The lid panels 202,204 are preferably joined in an abutting relationship by a hinge member 240, which is preferably a stainless steel continuous or piano hinge. In the depicted embodiment 200, the hinge 240 is provided along less than the lid length 203 so as to not interfere with the drainage holes 227 provided through the lid panels 202,204. Of course a hinge 240 extending the entire lid length 203 may be used, and if desired, the drain holes 227 may be spaced or arranged accordingly.

Figure 10E:
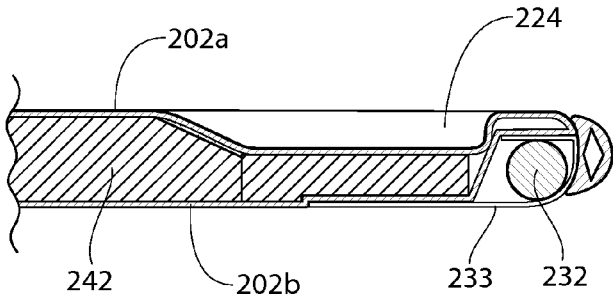
FIG. 10E is a partial cross-section view taken along line 10E of FIG. 10A.

As can be seen in FIGS. 10D and 10E, the lid panels 202,204 are preferably constructed of opposing layers of fiberglass cloth, impregnated with vinyl ester resin, and a layer of foam 242 disposed therebetween. A preferred foam layer 242 is formed from high density PVC foam. The top surfaces 202*a*,204*a* of the panels 202,204 may be coated with a polyester gel coat of a desired color. Formed into or disposed on the gel coat layer may be a desired texture formation to increase the friction thereof. A preferred tooling negative may be made to provide the texture during the molding process. Additionally or alternatively, a post-processing addition of texture may be performed, such as the addition of adhered texture or even splattered with additional polyester gel coat material.

Figure 11:
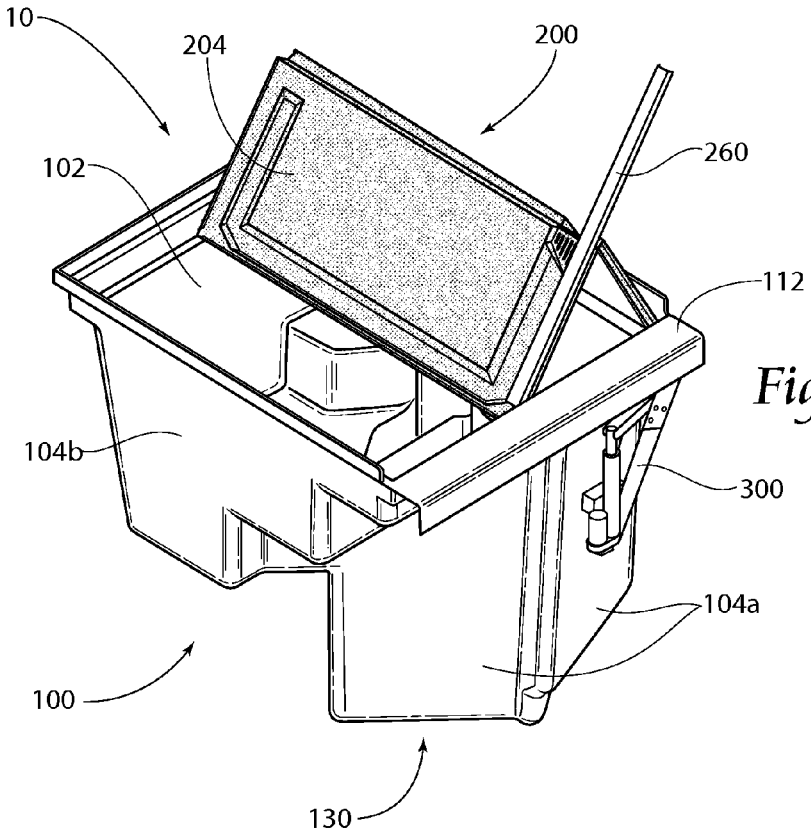
FIG. 11 is a perspective view of an alternate floor panel design.

In FIG. 11, an alternate lid embodiment is shown, including a front overlay arm 260, which is adapted to interface the vessel threshold 112 and overlay the abutment of the lid panels 202,204.

Figure 12:
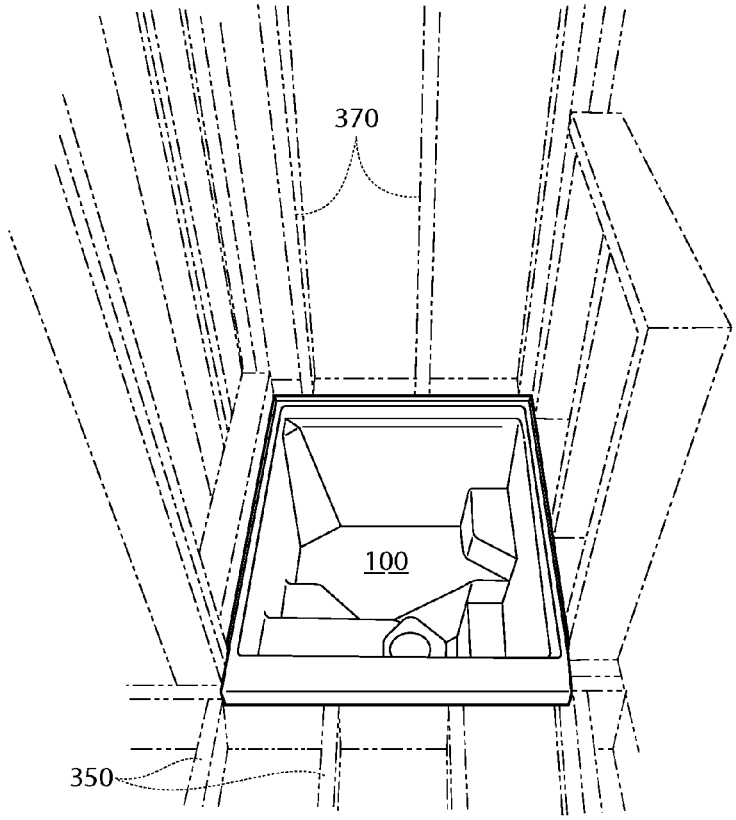
FIG. 12 is a front top perspective installation view of the embodiment of FIG. 2.

FIG. 12 depicts a vessel 100 according to the present invention situated upon a floor or floor joists 350 and within framing member 370 adapted to support wallboard or preferably a shower stall.

Figure 13A:
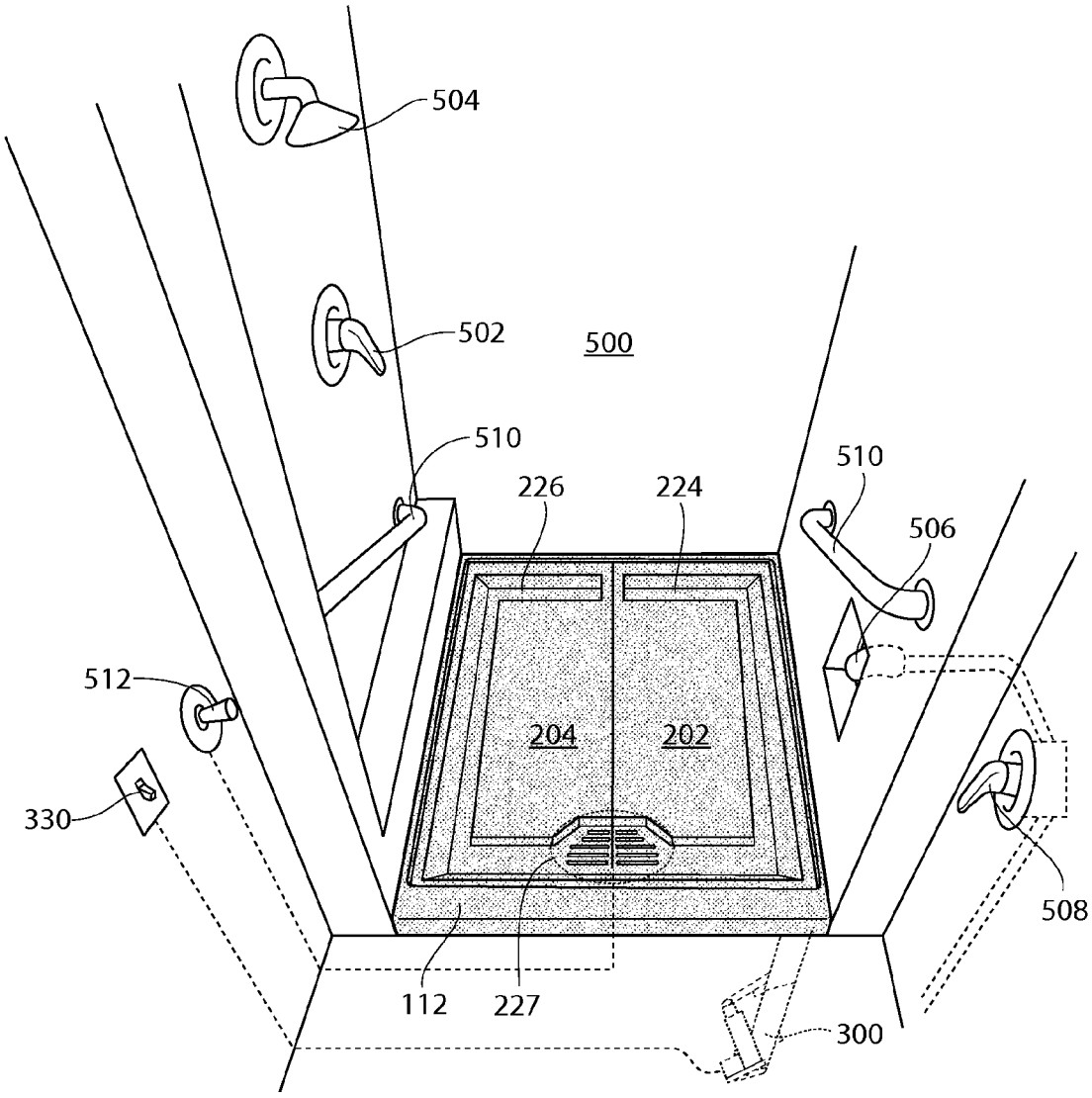
FIG. 13A is a front top perspective installation view of the embodiment of FIG. 1.
Figure 13B:
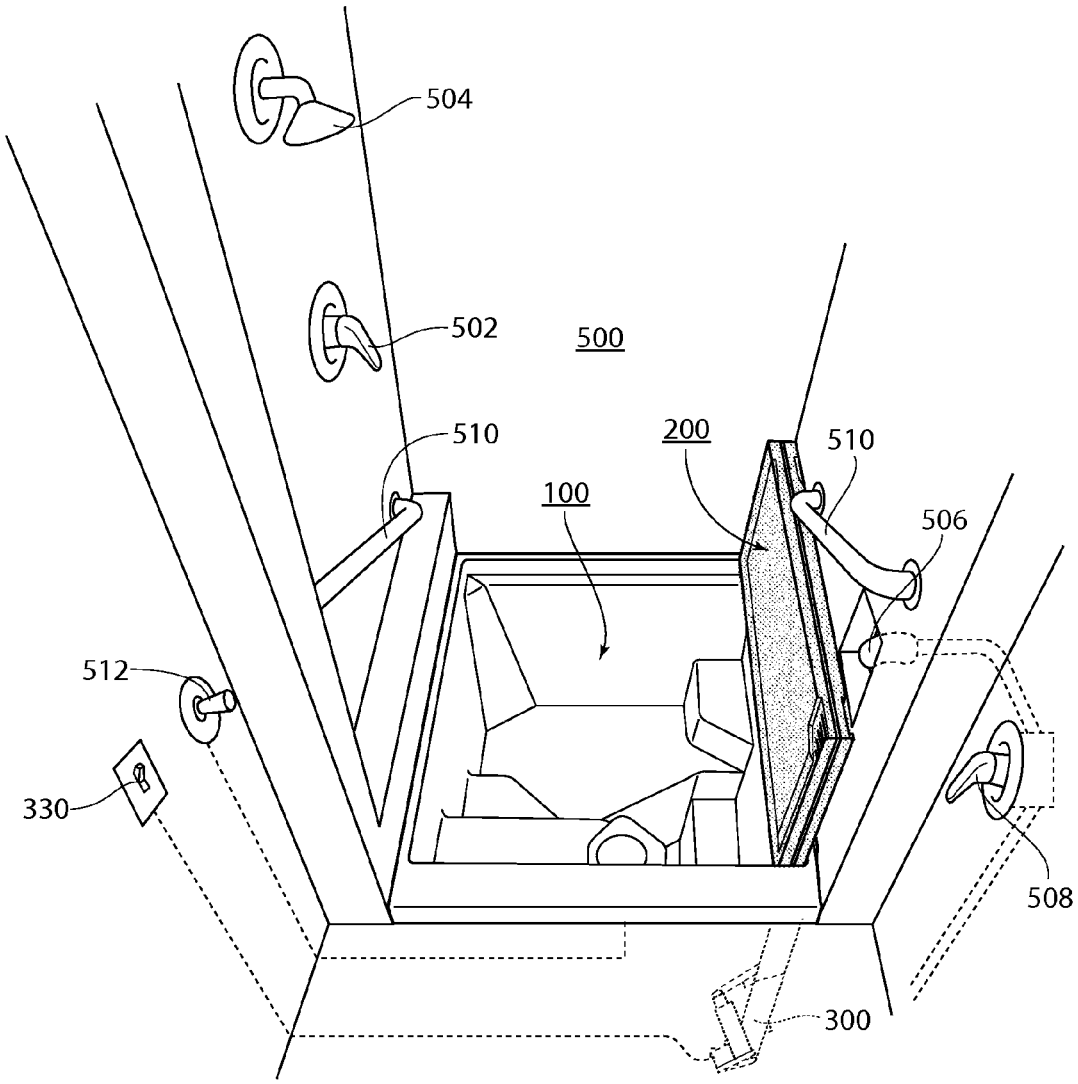
FIG. 13B is a front top perspective installation view of the embodiment of FIG. 1, further showing the lid in an open position.

FIGS. 13A and 13B depict a completed installation of an embodiment according to the present invention. FIG. 13A depicts a conventional shower stall 500 installed above an embodiment 10 according to the present invention. The stall 500 includes a shower control knob 502 which controls the flow of water to a shower head 504. Further, a dedicated vessel fill spout 506 may be provided, including its own control knob 508. Support rails 510, which may be inclined or declined, may be provided along one or more walls of the stall 500. A remote drain control 512 is preferably operatively coupled to a drain valve (not shown) to control the flow of fluid out of the first drain aperture 114*a* in the vessel. The drain control 512 may be a lever that actuates a cable coupled to the drain valve. Additionally, a switch 330 may be provided to control the lid actuator 300 for opening and closing the lid 200. Conventional shower closures (not shown) such as curtains or one or more shower doors may be used to shield the opening of the shower stall 500 above the vessel threshold 112.

While the lid 200 is in the down or closed position, as shown in FIG. 13A, a user may take a shower in the stall 500 using the showerhead 504 and controlling the flow of water therefrom by the use of the shower control knob 502. The texture provided on the top surfaces 202*a*,204*a* of the lid panels 202,204 helps to reduce slippage, and the lid is supported substantially or exclusively by the front lid support surface 106*a* and the rear lid support surface 106*b*. Accordingly, the lid 200 spans the entire cavity 102. The drain holes 227 provided through the lid panels 202,204 are arranged above the second drain aperture 114*b* provided through the vessel 100. In this way, wastewater from use of the showerhead 504 is generally directed to a sewer drain (not shown) by flowing into the drain channels 224,226, through the drain holes 227 and through the second drain aperture 114*b*, which is plumbed to the sewer drain, perhaps through a conventional trap arrangement.

When it is desirable to utilize the vessel 100 as a soaking tub, or to fill the vessel 100 with a desired amount of fluid, the lid 200 may be moved to the up or open position. To accomplish this, the lid actuator 300 may be activated by a flip of the electrical switch 330 provided preferably outside the shower stall 500. Alternatively, the lid 200 may be moved manually or even removed completely. If the actuator 300 is used, it imparts a rotational force to the pivot rod 232, preferably causing the right lid panel 202 to rotate clockwise. As the right lid panel 202 rotates clockwise, the left lid panel 204, which is hingedly coupled to the right lid panel 202, is drawn towards the right lid panel 202 as the roller bearings 236,238 roll along the front lid support surface 106*a* and the rear lid support surface 106*b*. To fill the vessel 100, the lid 200 may be drawn up substantially out of obstruction and fluid flow through the first drain aperture 114*a* may be interrupted, such as by closing the drain valve (not shown) associated with the drain control lever 512. The vessel 100 may be supplied with fluid from the vessel fill spout 506 using the vessel fill control knob 508, which is preferably located outside of the shower stall 500. For safety and space saving reasons, the vessel fill spout 506 may be recessed into the shower stall 500. The vessel 100 is then filled to the desired fluid level with a desired fluid, such as water. For instance, the fluid level may be maintained below the seat 132*c* if a simple foot bath is desired. Alternatively, it may be desirable to completely submerse a user's body into the fluid, thus making a higher fluid level desirable. In any event, if the fluid level exceeds the level of the overflow drain surface 115, excess fluid will drain out of the second drain aperture 114*b* and into the previously mentioned sewer drain. Thus, it is preferred that the plumbing from the second drain aperture 114*b* intersects the sewer drain pipe at a downstream location from the drain valve (not shown) that may be used to interrupt the flow of fluid through the first drain aperture 114*a*. In any event, once the vessel 100 is filled to the desired level, it may be used, such as a user stepping along the staircase path 135 while perhaps grasping the support rails 510 provided.

However, the vessel 100 need not be used for soaking when it contains fluid. Stated another way, the vessel 100 does not need to be drained of fluid if a user wishes to take a shower in the stall 500. Once the lid 200 is lowered to the closed position, as in FIG. 13A, a user may take a shower without fear of substantial contamination of the vessel 100 or fluid in the vessel 100 because the shower water drains through the overflow drain aperture 114*b* and not through the first drain aperture 114*a*. In this way, fluid may be maintained for multiple soaking uses in the vessel 100 while the shower 500 is used to cleanse prior to and/or after soaking.

The foregoing is considered as illustrative only of the principles of the invention. Furthermore, since numerous modifications and changes will readily occur to those skilled in the art, it is not desired to limit the invention to the exact construction and operation shown and described. For example, alternatively or additionally, a unitary lid (not shown) may be provided to be inserted and removed as desired. Additionally or alternatively, the system 10 may be provided without a lid 200 in the event that the system 10 will be used only as a top ingress tub. While the preferred embodiment has been described, the details may be changed without departing from the invention, which is defined by the claims.

I claim:

1. A bathing device comprising:

a fluid-containing vessel having an open top;

a lid configured to nest in the vessel top, the lid further including at least one drain hole formed therethrough;

a first drain aperture formed through the vessel adapted to drain fluid from a majority of the vessel;

a second drain aperture formed through the vessel, the second drain aperture being configured to receive fluid from the at least one drain hole formed through the lid when the lid is nested in the vessel; and wherein the lid has a top surface and a bottom surface, and further wherein when the lid is nested in the vessel, the bottom surface is oriented towards the first drain aperture and the second drain aperture, the lid top surface further comprising at least one drain channel configured to guide fluid from the lid top surface towards the at least one drain hole.

2. A bathing device comprising:

a fluid-containing vessel having an open top;

a lid configured to nest in the vessel top, the lid further including at least one drain hole formed therethrough, wherein the lid comprises a plurality of lid panels having substantially planar top surfaces;

a first drain aperture formed through the vessel adapted to drain fluid from a majority of the vessel; and a second drain aperture formed through the vessel, the second drain aperture being configured to receive fluid from the at least one drain hole formed through the lid when the lid is nested in the vessel.

3. A bathing device according to claim 2, wherein the lid comprises a first lid panel and a second lid panel.

4. A bathing device according to claim 3, wherein the first lid panel is hingedly coupled to the second lid panel.

5. A bathing device according to claim 4, wherein the first lid panel is pivotably coupled to the vessel.

6. A bathing device according to claim 4, wherein the second lid panel is translatable across at least a portion of the vessel.

7. A bathing device comprising:

a fluid-containing vessel having an open top;

a lid configured to nest in the vessel top, the lid further including at least one drain hole formed therethrough, a first drain aperture formed through the vessel adapted to drain fluid from a majority of the vessel;

a second drain aperture formed through the vessel, the second drain aperture being configured to receive fluid from the at least one drain hole formed through the lid when the lid is nested in the vessel; and a drain valve having a selectively closeable fluid flow conduit including an input in fluid communication with the first drain aperture and an output in fluid communication with a drain pipe.

8. A bathing device according to claim 1, wherein the second drain aperture is in fluid communication with the drain pipe.

9. A bathing device according to claim 7, wherein the drain valve is remotely operable.

10. A bathing device according to claim 9, wherein the drain valve is cable actuated.

* * * * *